United States Patent [19]

Bell et al.

[11] 4,223,705

[45] Sep. 23, 1980

[54] WIRE KNOTTING MACHINE

[75] Inventors: George E. Bell, Florence, Miss.; John P. Gowing, Joplin, Mo.

[73] Assignee: Flex-O-Lators Inc., Carthage, Mo.

[21] Appl. No.: 19,226

[22] Filed: Mar. 9, 1979

[51] Int. Cl.[3] ..... B21F 1/06

[52] U.S. Cl. ..... 140/104; 140/24; 140/115

[58] Field of Search ..... 140/93 R, 101, 104, 140/115, 1, 24, 92

[56] References Cited

U.S. PATENT DOCUMENTS

| | | | |
|---|---|---|---|
| 518,426 | 4/1894 | Randall | 140/115 |
| 1,212,437 | 1/1917 | Bates | 140/101 |
| 2,007,030 | 7/1935 | Vaile et al. | 140/104 |
| 3,070,135 | 12/1962 | Thompson et al. | 140/24 |

*Primary Examiner*—Lowell A. Larson

*Attorney, Agent, or Firm*—John A. Hamilton

[57] ABSTRACT

A machine operable to twist the end portion of a cross wire around a longitudinal wire disposed at right angles to the cross wire, and then to twist the cross wire end portion about the standing portion of the cross wire, to form a "knot". The machine consists of a knotter die rotatable about the axis of the longitudinal wire to form the first twist, and to force the end portion of the cross wire operatively against an anvil configurated to form the second twist so that both twists are formed in a single operation, although the two twists lie in substantially right angled planes. This substantially doubles the speed at which the knots may be formed in automatic machinery. As optional equipment, other dies may be added for pressing the wire bend formed in the second twist, and the raw end of the cross wire, closely adjacent the longitudinal wire, so that the raw wire ends are shielded. This knot "finisher" operation is performed at a station different from that at which the knot is initially formed, so that in an automatic machine, the finishing operation does not reduce the production rate.

9 Claims, 17 Drawing Figures

WIRE KNOTTING MACHINE

Figure 1:
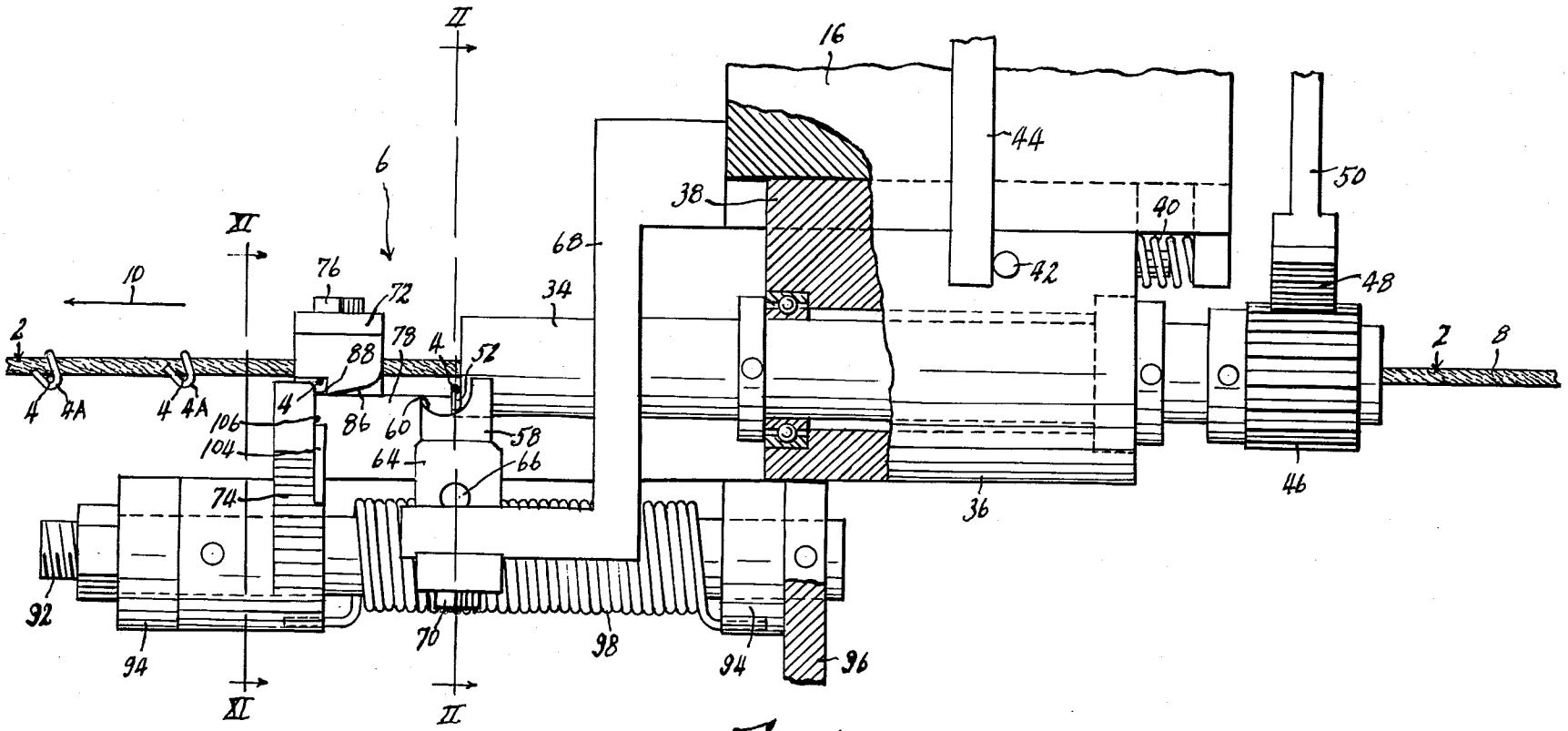

This invention relates to new and useful improvements in wire knotting machines, and has particular reference to a machine adapted to twist the end portion of a first wire first about a second wire disposed at right angles to the first, and then to twist the projecting end portion of the first wire about its own standing portion to form a secure connection between the wires. This connection, although commonly denoted in the trade as a "knot", is not a knot in the technical sense that a strand is led through a loop or bight formed in itself.

The invention will be described in connection with its use in the formation of a flat grid spring for upholstery structures, although it will be readily apparent that its use is not limited to this purpose. Flat grid springs commonly consist of a pair of parallel longitudinal spring side wires, with a continuous series of closely spaced apart spring cross wires extending laterally between and knotted at their ends about said side wires, and are commonly formed by automatic machinery in which the side wires are longitudinally advanced with an intermittent motion, the cross wires being advanced longitudinally and successively into position at a given station, cut to proper length, and knotted about the side wires while the side wires are at rest.

The described wire connection, or "knot", is not new in and of itself, but heretofore the two twists involved therein, the first of the cross wire around the side wire, and the second of the cross wire about its own standing portion, have been regarded as two separate operations, each requiring its own set of wire-bending dies. Hence the second twist could not be commenced until the first was completed, and this fact essentially doubled the time the side wires were required to remain at rest while the knots were formed. The two separate operations were deemed necessary since the two twists must be formed in planes generally at right angles to each other. This use of two twisting operations of course severely limited the rate at which the cross wires could be inserted and knotted, and hence limited the production rate of the spring grid.

Accordingly, the primary object of the present invention is the provision of a wire knotting machine capable of forming a knot of the type described with a single set of dies, and with a single motion of a driver member, whereby to form both the first and second twists in a time no greater than has heretofore been required for the formation of only the first twist. Generally, this object is accomplished by the provision of a driver which engages the end portion of a cross wire and turns it around the side wire to form the first twist, and by imposing a fixed anvil in the path of the cross wire end, said anvil being configurated to guide the cross wire end around its own standing portion, whereby the second twist is formed during the final portion of the formation of the first twist. An approximate doubling of the production rate of the machine is thus permitted.

The machine as thus far described provides a knot the second twist of which, that is, the bend of the cross wire end about its own standing portion, is spaced apart from the side wire, and in which the raw end of the cross wire projects away from the cross wire in an exposed position. This condition is permissable in some cases, such as when the resultant grid spring is to be completely enclosed, but in some cases, such as when the spring is to be exposed in use, the raw wire ends could inflict injury, snag upholstery fabrics, and the like. Accordingly, another object of the invention is the provision of means whereby each knot may be "finished" by pressing the second bend of the cross wire, and its raw end, into close proximity to the side wire, whereby the raw end is shielded. This finishing operation, when its use is desired, is performed at a station in the movement of the side wires subsequent to that at which the knots are initially formed, so that it can occur, with respect to the knots of one cross wire, at the same time the knots of the next subsequent wire are being initially formed. In this manner, the finishing operation does not reduce the production rate of the machine.

Other objects are simplicity and economy of structure, and efficiency and dependability of operation.

Figure 2:
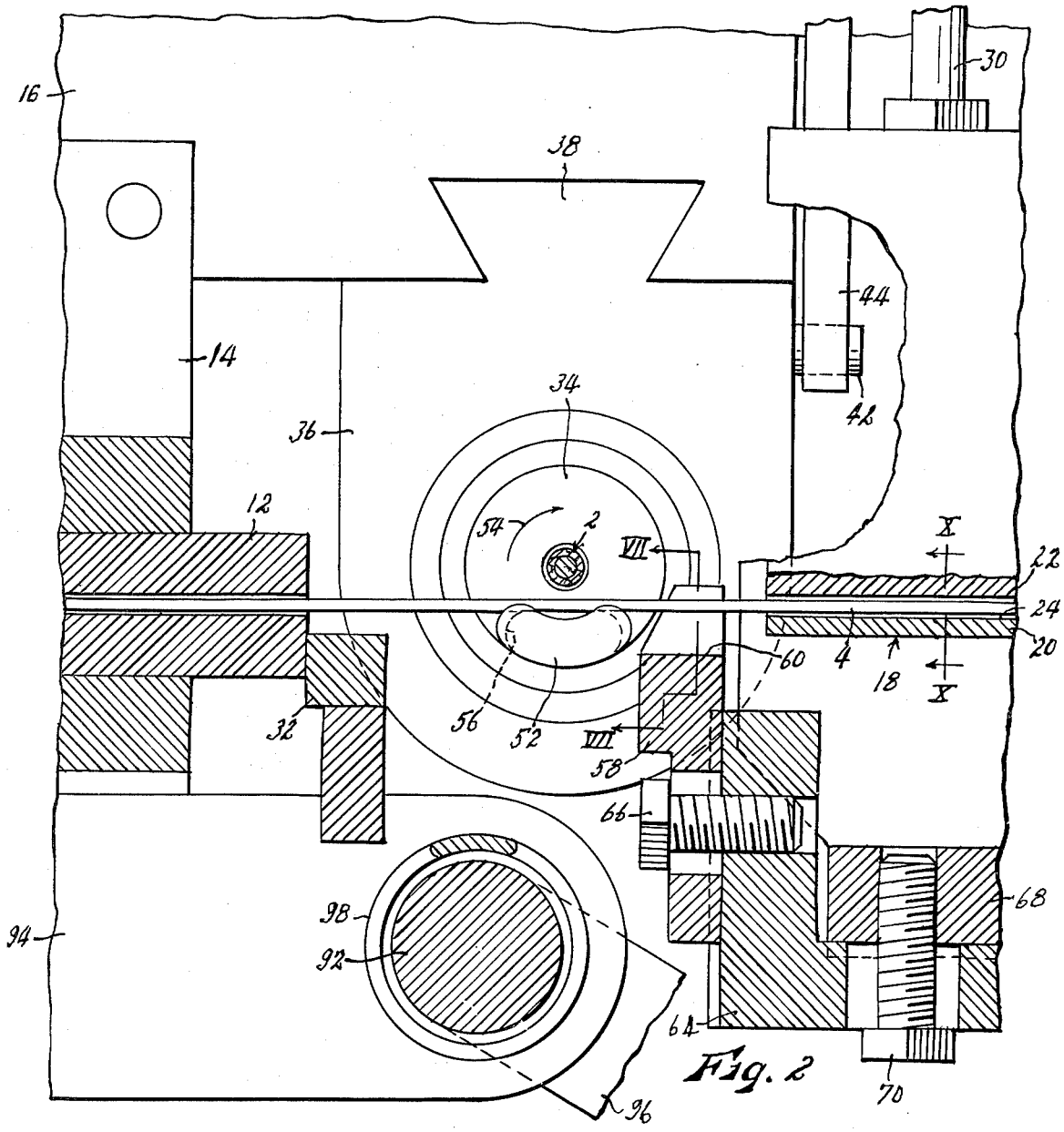
Figure 3:
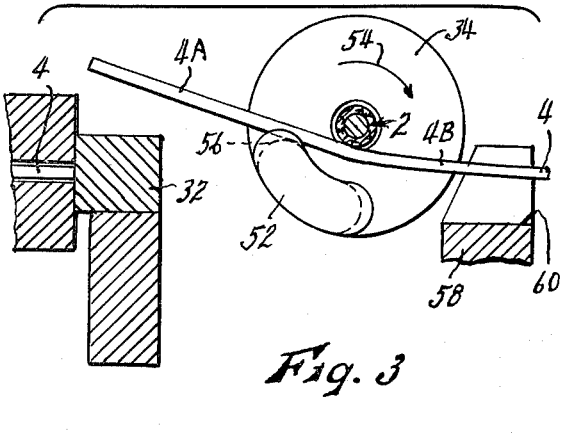
Figure 4:
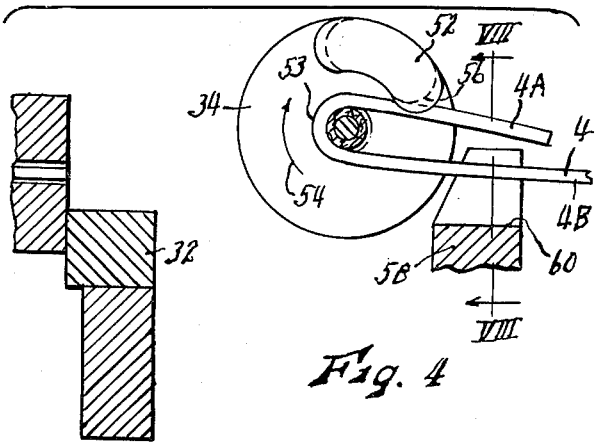
Figure 5:
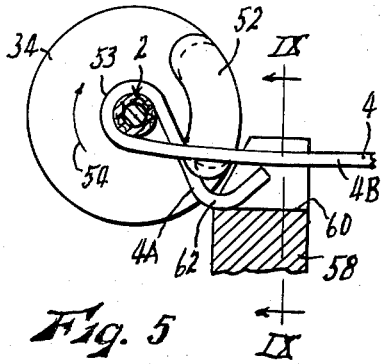
Figure 6:
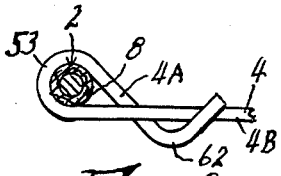
Figure 7:
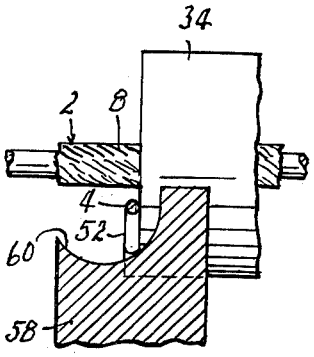
Figure 8:
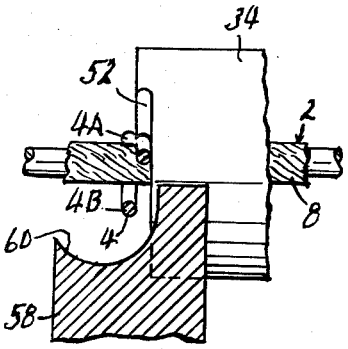
Figure 9:
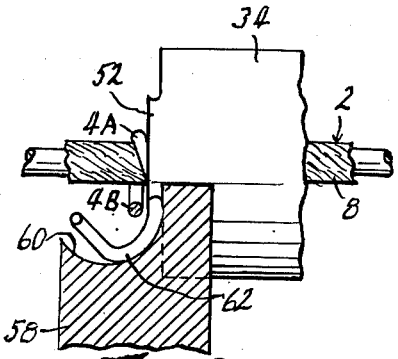
Figure 10:
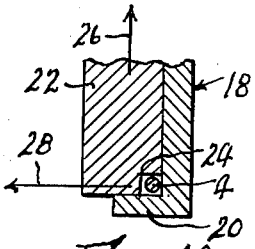
Figure 11:
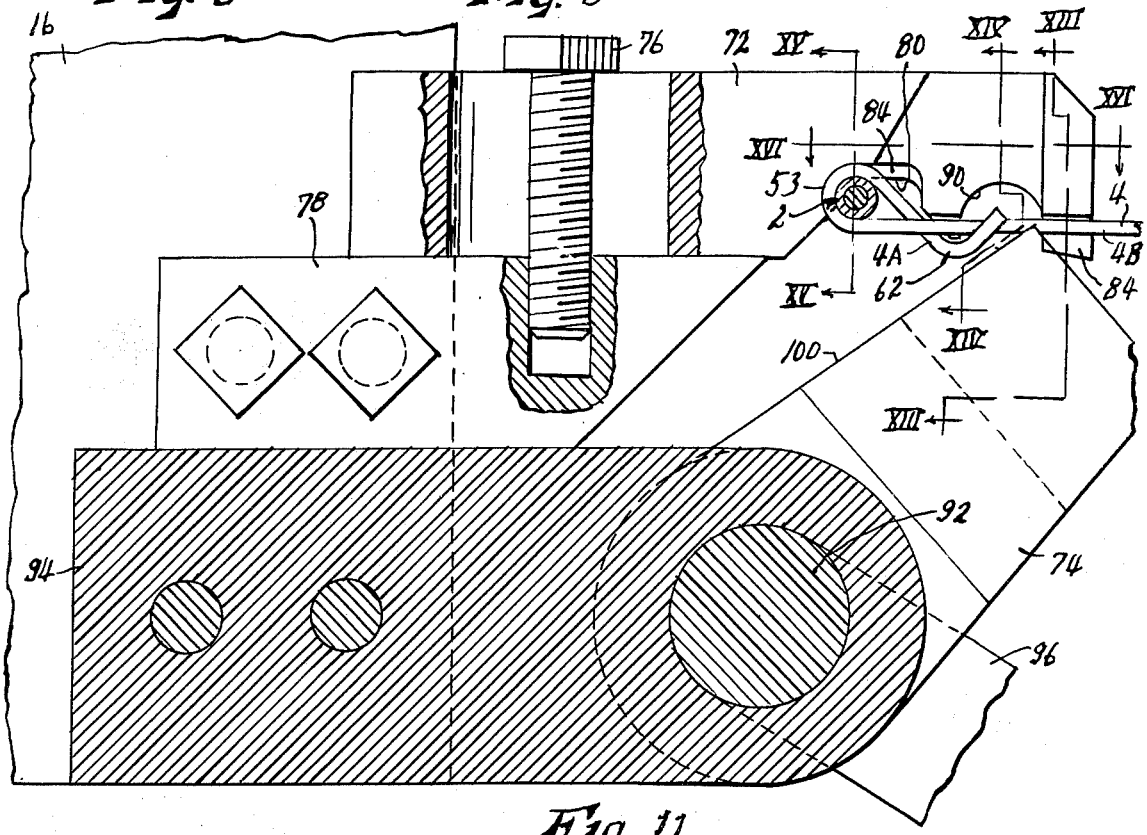

With these objects in view, as well as other objects which will appear in the course of the specification, reference will be had to the accompanying drawing, wherein:

FIG. 1 is a side elevational view of a wire knotting machine embodying the present invention, with parts omitted and parts broken away, FIG. 2 is an enlarged, fragmentary sectional view taken on line II—II of FIG. 1, showing the parts as positioned at the commencement of the formation of a knot, FIG. 3 is a fragmentary view similar to FIG. 2, showing the parts as positioned at an intermediate stage in the formation of a knot, FIG. 4 is a view similar to FIG. 3, showing the parts as positioned at a still more advanced stage in the formation of a knot, FIG. 5 is a fragmentary view similar to FIG. 4, showing the parts as positioned at the completion of the formation of a knot, FIG. 6 is a view similar to FIG. 5, showing the knot only, separated from the machine, FIG. 7 is a fragmentary sectional view taken on line VII—VII of FIG. 2, FIG. 8 is a fragmentary sectional view taken on line VIII—VIII of FIG. 4, FIG. 9 is a fragmentary sectional view taken on line IX—IX of FIG. 5, FIG. 10 is a fragmentary sectional view taken on line X—X of FIG. 2, FIG. 11 is an enlarged fragmentary sectional view taken on line XI—XI of FIG. 1 showing elements for performing the knot "finishing" operation, prior to the commencement of said operation.

Figure 12:
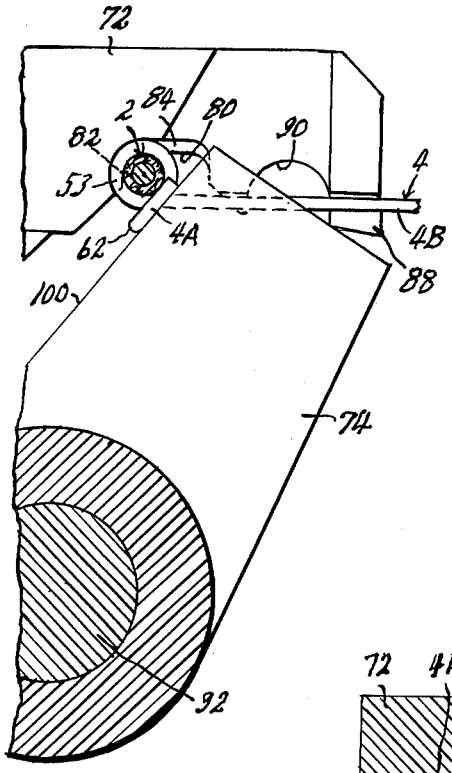
Figure 13:
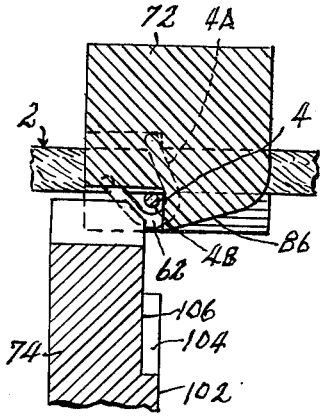
Figure 14:
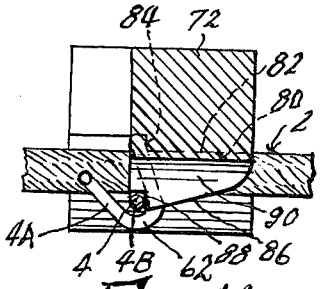
Figure 15:
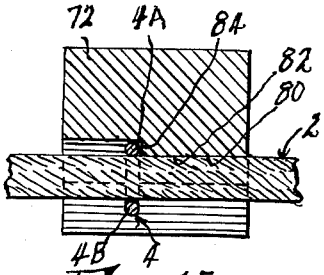
Figure 16:
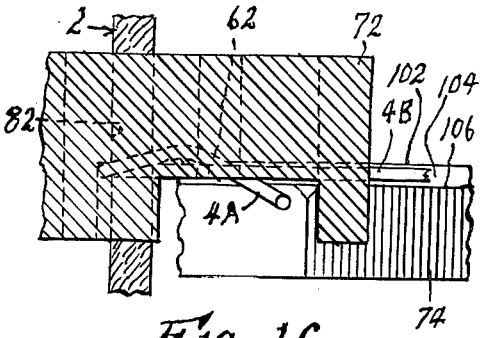
Figure 17:
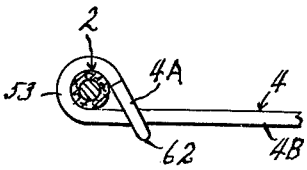

FIG. 12 is a fragmentary view similar to FIG. 11, showing the parts as positioned at the completion of the knot "finishing" operation, FIG. 13 is a fragmentary sectional view taken on line XIII—XIII of FIG. 11, FIG. 14 is a sectional view taken on line XIV—XIV of FIG. 11, FIG. 15 is a sectional view taken on line XV—XV of FIG. 11, FIG. 16 is a fragmentary sectional view taken on line XVI—XVI of FIG. 11, and FIG. 17 is a view similar to FIG. 12, showing the knot only, separated from the machine.

Like reference numerals apply to similar parts throughout the several views. The grid spring to be formed comprises a wire fabric including a pair of parallel side wires 2 (one shown) and a series of closely spaced apart parallel cross wires 4 extending transversely between said side wires and knotted at their ends about said side wires by the machine forming the subject matter of the present invention, which is indicated generally by the numberal 6 in FIG. 1. Side wires 2 are usually each provided with a sheath 8 (see FIG. 6) of twisted paper or other soft, indentable material, and are often referred to as "ropes" because of their resemblance thereto. Both the side wires and the cross wires are formed of spring steel, the side wires being relatively heavy and the cross wires being relatively light. The grid is illustrated as being formed in a horizantal plane. During the grid formation, the side wires are transported longitudinally and concurrently to the left as viewed in FIG. 1, in the direction of arrow 10, which will be termed the "forward" direction. They are advanced with an intermittent motion, the distance between stops being equal to the desired spacing between successive cross wires 4, by any suitable mechanism, not shown as forming no intrinsic part of the present invention, but well understood in the art. Each time the side wires come to rest, a cross wire 4 is knotted thereabout by the knotting machine 6. The knotting machine shown is for forming the knots at the right side wire 2, as viewed when facing forwardly, and it will be understood that the knots at the left side wire are formed by a similar but reversed machine.

Referring to FIG. 2, it will be seen that wire for cross wires 4 may be fed from a reel source, not shown, through a tubular guide 12 carried by a bracket 14 affixed to machine frame 16, by any suitable means, not shown. The wire emerges from guide 12 at a distance outside of side wire 2 such as to provide a wire length outside of the side wire sufficient to form the knot, then passes transversely just below said side wire, then through a guide 18 which starts in inwardly spaced relation from right side wire 2 and extends to a similar relation to the left side wire, to extend outwardly beneath the left side wire at least as far as guide 12 is spaced outwardly, from the right side wire. As detailed in FIG. 10, guide 18 consists of a fixed portion 20 and a vertically movable portion 22, the portions normally cooperating to form a tunnel 24 through which wire 4 may be advanced. Movable portion 22 may be elevated upwardly as indicated by arrow 26 in FIG. 10, whereby the holder is opened and wire 4 may exit transversely forwardly from the holder, as indicated by arrow 28, as will appear. Movable guide portion 22 is lifted by a rod 30 (see FIG. 2) at the proper times, as will appear.

As a first step in the knotting process, a wire cutter blade 32 is actuated to sever the wire at the end of guide 12, the normal position of the blade being shown in FIGS. 2 and 4, and its position, when actuated being shown in FIG. 3. The portion of the cross wire outside of the side wire will be denoted its "end portion" 4A, and the portion thereof between the side wires will be denoted its "standing portion" 4B.

Disposed just behind wire 4, between guides 12 and 18, is a driver member 34 constituting a tubular shaft which is horizontal and extends forwardly and rearwardly at right angles to wire 4, and through the central bore of which side wire 2 is advanced to pass just above cross wire 4. The rearward portion of the driver is carried rotatably in a carrier 36, which in turn is mounted for forward and rearward sliding movement in machine frame 16, as by a sliding dovetail connection 38. Carrier 36 is biased forwardly by a frame-based spring 40 (see FIG. 1) to urge a transverse pin 42 thereof against a lever 44. Said lever is carried pivotally by machine frame 16, and is pivotally driven with a reciprocal motion to cooperate with spring 40 to move carrier 36 and driver 34 between a forward position in which the forward end of the driver substantially touches cross wire 4, and a rearward position in which the forward end of the driver is spaced rearwardly of wire 4 by a distance slightly greater than the diameter of the cross wire. Driver 34 is turned oscillatably by a pinion gear 46 (FIG. 1) fixed on its rearward end, which is engaged by a gear segment 48 carried by an oscillatable arm 50 which it will be understood is pivoted on machine frame 16, and driven by means to be described, to oscillate the driver through less than a full revolution. At its forward end, driver 34 is provided with a forward extension 52, projecting approximately the diameter of wire 4, and being eccentric to the driver axis and normally projecting forwardly beneath wire 4, as in FIG. 1.

In the next step of the knotting process, driver 34 is turned in the direction of arrow 54 in FIGS. 2-5, by operation of gear members 46-48, just after wire 4 has been severed by blade 32 as in FIG. 3. During this turning of the driver, its extension 52 first engages end portion 4A of wire 4, and bends it around side wire 2, as indicated at 53, till it overlies standing portion 4B of wire 4, as in FIG. 4. During this portion of the driver rotation, said driver is also retracted rearwardly against spring 40 by lever 44, so that by the time the FIG. 4 position is reached, the free end portion 4A of the wire will be disposed just behind standing portion 4B, as best shown in FIG. 8. The leading edge of driver extension 52 is undercut as indicated at 56 in FIG. 1, and wire end 4A rests in the undercut, to insure that it does not slip out of engagement with the extension during the turning and rearward retraction of the driver. Thus, as the rotation of driver 34 continues, to the position shown in FIGS. 5 and 9, the extreme end portion of wire end 4A, which projects outwardly from driver extension 52, is lead downwardly behind standing wire portion 4B, and then formed to bend forwardly and upwardly under wire portion 4B by an anvil 58.

Anvil 58 has the form of an upwardly projecting finger, the upper end of which is at about at the level of side wire 2, and is upwardly concave, as at 60, about an axis of curvature at right angles to the side wire. Said concavity extends from about the plane of the forward end of the driver, forwardly beneath standing portion 4B of the wire. Thus as wire end 4A is pressed forcibly downwardly against the anvil, it is forced to bend forwardly beneath wire section 4B, as best shown in FIG. 9, to form a hook bend 62 engaged below wire 4B. Referring to FIGS. 1 and 2, it will be seen that the lower end of the finger constituting anvil 58 is connected to a bracket 64 by a bolt 66 in a manner to permit vertical adjustment of the anvil, and the bracket 64 is affixed to a second bracket 68 by a bolt 70 in a manner to permit adjustment of the anvil transversely to side wire 2, so that the anvil may be accurately adjusted depending on the wire diameter and resilience, as well as other variable factors. It will be understood that bracket 68 is affixed to machine frame 16.

When driver 34 reaches the position shown in FIGS. 5 and 9, the knot is substantially complete, and the driver is rotated to its original position in a direction opposite to arrows 54 by its gears 46-48, and returned forwardly by spring 40, preparatory to receiving the next cross wire after side wires 2 have advanced forwardly one more step, guide 18 opening at this time to permit forward movement of the knotted cross wire.

Due to the resilience of the cross wire, it will rebound from the FIG. 5 position when released by the driver, recovering for example to the position shown in FIG. 6, bringing hook 62 into engagement with standing wire portion 4B, or nearly so. Although not specifically illustrated, it will be understood that in a manner well known in the machine art, the means for intermittently advancing side wires 2, the means for advancing cross wires 4 into position, the means for actuating wire knife 32, the means for operating driver rotating gears 46–48, the means for operating driver retractor lever 44, and the means for operating lifter 30 to open and close guide 18, are all accurately synchronized in order that all of the described operations occur at the proper moments. This may be done, for example, by driving all of the enumerated devices from cams on a common cam shaft, so that slight adjustments of the cams will properly synchronize all functions. This is considered to be well within the known scope of the art.

The operational speed of the machine is high. A machine substantially as shown, except that it did not include anvil 58 which is the principal feature of the present invention, but formed the hook bend 62 by a separate mechanical means which had to be actuated only after bend 53 of the cross wire around the side wire was completed and hence caused a delay, has been used for many years and has consistently functioned to insert and knot about 150 cross wires per minute, the precise rate depending on the width of the spring grid being formed, since this factor determines the time required to shoot the cross wires into position. However, with the use of anvil 58, which provides that both the bend 53 of the cross wire about the side wire, and also the formation of hook 62, are accomplished in a single motion of driver 34, provides a production rate of about 300 cross wires per minute. This is an extremely important feature from the viewpoint of production economy.

The knot formed as thus far described, and as shown in FIG. 6, is a complete knot and provides a product which is entirely satisfactory for many purposes, such for example as when the product spring grid is to be totally enclosed in an eventual upholstery structure. However, a knot of this form does leave the cut raw ends of the cross wires projecting and exposed, so that they could snag anything they contact, thus doing damage or inflicting injury, and thus would be objectionable in certain other uses, such for example of when the spring grid, either bare or plastic-coated, is to be exposed and used to support free cushions or the like.

To overcome this possible disadvantage of the FIG. 6 knot, an optional knot "finisher" may be used, and is shown in FIGS. 11–17. The finisher comprises a pair of cooperating die members consisting of an anvil finger 72 and a radial arm 74. Anvil finger 72 extends transversely to side wire 2, at the level thereof, forwardly of the position at which a cross wire 4 is being knotted about said side wire, by a distance equal to the desired spacing between successive cross wires. Said anvil finger overlies the side wire at its inner end portion, and is affixed at its outer end, by a screw 76, to a bracket 78 which it will be understood is affixed to machine frame 16. Said anvil is provided at its lower side with a notch 80 through which side wire 2 may advance longitudinally. Said notch provides a rounded corner 82 which when the side wire is engaged therein, braces said wire against upward or outward movement. The notch is enlarged at its forward end to present a forwardly facing shoulder 84, intermediate its forward and rearward end, which enlargement accommodates the bend 53 of the just previously knotted cross wire 4 about the side wire, with shoulder 84 then bracing the bend of wire 4 against rearward movement. Obviously, for the knot to pass through the smaller portion of notch 80 to arrive at the described position, the side wire must be deflected downwardly, and for this purpose the lower rearward portion of the portion of anvil finger 72 inwardly of said notch is bevelled downwardly and forwardly at its lower rearward portion as indicated at 86, and as best shown in FIGS. 13 and 14. As the side wire advances, cross wire 4 immediately adjacent the side wire engages said bevel, and is deflected downwardly, together with the side wire, until just as the side wire comes to rest, it snaps upwardly to engage the knot in the enlarged portion of notch 80, as wire 4 snaps up in front of a forwardly facing shoulder 88 of the anvil. As wire 4 moves forwardly under bevel 86, its extreme end portion at the cut end thereof, which may extend above the standing portion 4B thereof as shown in FIG. 11, is accommodated in a forwardly and rearwardly extending groove 90 formed in the lower surface of the anvil. The parts will then have the positions shown in FIGS. 11 and 13–16. The enlarged forward portion of notch 80, and also shoulder 88, open through the forward surface of the anvil finger, so that the wire knot may emerge freely therefrom when the side wire next advances. Arm 74 is affixed to and extends radially from a horizontal shaft 92 parallel to the side wire in downwardly and outwardly spaced relation therefrom. Said shaft is carried by bearings 94 which it will be understood are affixed to machine frame 16. At the rearward end of said shaft, there is affixed thereto a crank 96 by means of which arm 74 may be angularly oscillated, being turned in one direction by said crank, and returned in the opposite direction by a torsion spring 98 surrounding shaft 92, being anchored at one end in one of bearings 94, and at its opposite end in the hub of arm 74.

Arm 74 is generally planar in a plane normal to side wire 2, and its normal or "returned" position is best shown in FIG. 11, with an edge surface 100 thereof confronting the side wire, but spaced apart inwardly therefrom by such a distance that the arm does not interfere with forward movement of the side or cross wires. The rearward surface 102 of the arm is planar and vertical, and coplanar with the shoulder 88 of the anvil finger, except that the upper portion of the rear surface of said finger is cut away, as indicated by shoulder 104 (see FIG. 13) to provide a vertical surface 106 spaced apart from finger shoulder 88 by a distance slightly greater than the diameter of wire 4. Then, when arm 74 is turned by operation of crank 96 from the position shown in FIG. 11 to that shown in FIG. 12, it embraces and traps standing portion 4B of wire 4 between shoulder 88 of the finger and surface 106 of the arm, and edge surface 100 of the arm engages first the bend 62 of wire end 4A, and then presses all of said wire end against the side wire, also as shown in FIG. 12. This "finishes" the knot by moving bend 62 of wire portion 4A, and also the raw cut end of the wire, closely adjacent side wire 2, so that said raw end is shielded, and is far less likely to snag layers of upholstery cloth applied thereover, or to inflict injury. The wire end 4A rebounds resiliently to some degree when released from between finger 72 and arm 74 by the return of arm 74 to its FIG. 11 position, as shown in FIG. 17. Also, the cut end of the wire may be pressed into the soft sheath 8 of the side wire, for still better shielding. It will be understood that crank 96 is powered from the same common cam shaft, or other common drive means, as is driver 34 which initially forms the knot, and with the means for advancing the side wires intermittently, so as to remain properly synchronized therewith.

The operation of the machine is believed to have been adequately described in connection with the foregoing description of its construction. It "knots" the wires at a rate believed unattainable with any prior machine. The primary feature contributing to this speed is of course that a single turn of driver 34 both bends wire 4 around side wire 2 at 53, and also forms bend 62 of wire end portion 4A about standing portion 4B. Heretofore it has been considered necessary to make these two bends in separate operations, thus slowing the production rate of the machine. This improvement is accomplished principally, as compared to previous machines, of removing any previously used mechanism for forming bend 62, and substituting therefore the specially formed anvil 58, which functions to form bend 62 simultaneously with the final portion of the bending movement of cross wire 4 around side wire 2. The increase of the production rate of the machine thus provided is rather startling. The knot "finishing" operation provided by finger 72 and arm 74 is of course a separate operation requiring a finite time interval for its performance, but this does not slow the production rate of the machine, since it is performed at a separate station in the forward travel of the cross wires, simultaneously with the initial formation of the next following knot by driver 34. It should also be kept in mind that for many uses of the spring grid produced, the finishing operation is neither required nor needed. The knot finishing elements are therefore optional equipment.

While we have shown and described a specific embodiment of our invention, it will be readily apparent that many minor changes of structure and operation could be made without departing from the spirit of the invention.

What we claim is:

1. A wire knotting machine for securing a first wire to a second wire extending at right angles to the first, said first wire being closely adjacent the second, and having a standing portion extending in one direction from said second wire and a relatively short end portion extending oppositely from said second wire, said machine comprising:

a. a driver member rotatable coaxially with said second wire and having an extension parallel but eccentric to its axis and normally underlying said first wire at the side thereof opposite from said second wire, b. means operable to turn said driver member with an angularly reciprocal motion, whereby during the motion thereof in one direction, the extension thereof engages the end portion of said first wire and bends it around said second wire toward its own standing portion, and c. a fixed anvil having an arcuate concavity which has an axis of curvature generally parallel to the first wire, and curved about said first wire standing portion, in spaced apart relation therefrom, at the side thereof opposite to that toward which the end portion thereof is moved by said driver member, said anvil being disposed so as to be engaged by the part of the end portion of said first wire projecting outwardly from its point of engagement by said driver extension, said driver operating to force said projecting wire portion against said anvil concavity, whereby said projecting wire end portion is bent around the standing portion thereof at the side thereof opposite to the direction it was caused by said driver to approach said standing portion, during the final portion of the movement of said driver, both the bend of the first wire about the second wire, and the bend of its end portion about its standing portion, thereby being accomplished by a single motion of said driver member in one direction, after which said driver member returns to its starting position.

2. A wire knotting machine as recited in claim 1 wherein said driver extension is so configurated that when in engagement with the end portion of said first wire, it prevents lateral escape of said wire end portion therefrom in a direction parallel to said second wire, and with the addition of means operable during the rotation of said driver in said one direction to retract said driver and extension in a direction parallel to the driver axis, by a distance at least as great as the diameter of said first wire, whereby the extreme end of the first wire is caused to pass behind its standing portion to engage the concavity of said anvil, rather than engaging the standing portion thereof, and to advance said driver axially to its starting position as said driver turns angularly to its starting position.

3. A wire knotting machine as recited in claim 2 wherein the degree of retraction of said driver is slightly greater than the diameter of the first wire, wherein said driver is provided with an end face normal to said second wire and substantially engaging said first wire when said driver is in its starting position, said driver extension projecting from said driver end face by a distance less than the degree of retraction of said driver during the knotting operation, whereby said driver extension may pass the standing portion of the first wire during the knotting operation.

4. A wire knotting machine as recited in claim 3 wherein said driver member is tubular, said second wire being closely confined in the central bore thereof at said end face, whereby said second wire is substantially rigidly supported directly adjacent the point at which said first wire is bent around said second wire, as said bend is formed.

5. A wire knotting machine as recited in claim 1 wherein said fixed anvil is mounted by means permitting adjustable movement thereof both longitudinally and radially relative to the standing portion of the first wire, whereby to adapt the machine for use with first wires of various diameters and stiffnesses.

6. A wire knotting machine as recited in claim 1 with the addition of a knot finishing means operable, after the knot has been initially formed by said driver and said anvil, to press the entire knotted end portion of said first wire closely adjacent said second wire, whereby said second wire shields the raw end of said first wire.

7. A wire knotting machine as recited in claim 6 wherein said second wire is advanced longitudinally with an intermittent motion and a first wire is positioned and initially knotted by said driver and anvil at a fixed station each time the second wire comes to rest, and wherein said finishing means is positioned at a subsequent station in the movement of the second wire and is operable to finish a knot previously initially formed, simultaneously with the initial formation of the knot of a following first wire, whereby the use of the finishing means does not reduce the rate at which the first wires may be knotted about said second wire.

8. A wire knotting machine as recited in claim 7 wherein said knot finishing means comprises:

a. a second anvil intersecting said second wire and having a notch opening laterally of said second wire in which said wire is accommodated and through which said second wire may advance longitudinally, said notch providing lateral back-up support for said second wire at the side thereof opposite to that at which the end portion of the first wire is disposed when initially knotted, and b. a pivoted pressure arm having a longitudinal edge surface generally parallel to said second wire and normally spaced apart from said second wire at the side thereof at which the knotted end portion of the first wire extends, by a distance greater than the extension of said first wire end portion, and c. operating means for pivoting said pressure arm to move said edge surface thereof toward said second wire, said arm and second anvil closely embracing the standing portion of said first wire therebetween, whereby during this movement of the arm said edge surface thereof engages and presses the end portion of said first wire forcibly against said second wire.

9. A wire knotting machine as recited in claim 8 wherein the notch of said second anvil has a smaller portion capable of engaging said second wire closely, and an enlarged portion which opens laterally of the second wire, and forwardly with respect to the direction of travel of the second wire, and is of sufficient size to accommodate the enlargement of the second wire formed by the bend of a first wire thereabout, said second anvil being provided with a bevelled surface operable, during the forward movement of said second wire and the first wire knotted thereabout, to engage said first wire closely adjacent said second wire, and deflect said wires resiliently toward the open lateral side of said notch, whereby the enlargement of the second wire formed by the bend of the first wire by-passes the smaller portion of said notch and enters the enlarged portion thereof.

* * * * *